United States Patent [19]

Finke et al.

[11] Patent Number: 4,457,706

[45] Date of Patent: Jul. 3, 1984

[54] LADLE STATION SEAL

[75] Inventors: Harry P. Finke; John W. Morgan, II, both of Pittsburgh; Lee G. Poe, Bethel Park, all of Pa.

[73] Assignee: Bloom Engineering Company, Inc., Pittsburgh, Pa.

[21] Appl. No.: 404,552

[22] Filed: Aug. 2, 1982

[51] Int. Cl.[3] ..... F24J 3/00; C21B 7/04

[52] U.S. Cl. ..... 432/226; 266/281; 432/227

[58] Field of Search ..... 432/224, 225, 226, 227; 266/144, 281

[56] References Cited

U.S. PATENT DOCUMENTS

| | | | |
|---|---|---|---|
| 3,397,874 | 8/1968 | Augustine | 432/64 |
| 3,834,293 | 9/1974 | Danieli | 432/64 |
| 4,223,873 | 9/1980 | Battles | 266/281 |
| 4,359,209 | 11/1982 | Johns | 432/225 |
| 4,364,729 | 12/1982 | Fresch | 432/9 |

*Primary Examiner*—John J. Camby

*Attorney, Agent, or Firm*—Webb, Burden, Robinson & Webb

[57] ABSTRACT

A ladle preheat station includes a firing wall through which a burner fires into an open end of a ladle juxtapositioned with respect to the wall, an air curtain means positioned about the firing wall so as to direct a curtain of air toward the ladle to eliminate ambient air infiltration between the firing wall and the ladle lip. In a preferred form an insulating refractory is placed along the inner-most edge of the air curtain means to reradiate the radiated heat and minimize slot radiation heat losses.

7 Claims, 4 Drawing Figures

LADLE STATION SEAL

FIELD OF THE INVENTION

Our invention relates to ladle heating apparatus and more particularly to ladle preheat stations of either the cold air non-recuperated or hot air recuperated type.

BACKGROUND OF THE INVENTION

Refractory lined ladles are used in the production of ferrous and nonferrous metals to receive the molten metal during and after the various refining stages. These ladles are recycled and normally require preheating of the refractory lining between uses. In addition, new linings require drying as do linings which have been repaired through patching.

The placing of a burner head in a ladle, while simple, has proven to be inefficient and energy wasteful. As a result, cold air and hot air preheat stations have been employed. In a cold air ladle preheat station a ladle is juxtapositioned with respect to a refractory lined burner wall and a burner is fired through the wall into the ladle interior. Hot air preheat stations generally employ some type of hooded arrangement about the burner wall and a portion of the ladle so that the products of combustion are retained and utilized in a recuperator to preheat combustion air for the burner. In both types of preheat stations there is a need to eliminate or minimize the cold air infiltration which takes place between the firing wall and the ladle. Positioning the ladle against the wall so as to form a seal therebetween is difficult to achieve because the lip of the ladle is normally covered with solidified chunks of metal and other types of slag which disrupt the seal and/or cause damage to the sealing surface on the ladle heating apparatus.

In addition to the cold air infiltration between the firing wall and the ladle, radiation heat losses occur as the heat is radiated through the space between the ladle lip and the wall.

Air curtains in general are known and have been used in heat treating furnaces to prevent air losses. One such system is disclosed in U.S. Pat. No. 3,397,874 wherein an air curtain is used in connection with a cover for a soaking pit.

Forced air has been utilized in connection with a tundish cleaning and preheating apparatus as shown in U.S. Pat. No. 3,491,988. In this patent the forced air is utilized to divert flame and to protect the ladle tipping mechanism from the preheating unit.

An annular air screen has also been employed to form a vertical closed chamber for conveying smoke leaving a furnace to a hood located above the furnace. This is illustrated in U.S. Pat. No. 3,834,293.

SUMMARY OF THE INVENTION

Our invention eliminates cold air infiltration between the burner firing wall and the ladle for horizontal or vertical ladle heating stations. By doing so we are able to significantly reduce the fuel consumption required to heat the ladle.

We are also able to minimize slot radiation heat losses which occur in the slot or gap between the ladle and the burner wall. By minimizing this slot radiation heat loss we are again able to minimize heat consumption in the overall system.

We are also able to manually or automatically control and vary or maintain constant the quantity of seal air we employ and that quantity can be made dependent on the burner firing rate and the size of the gap between the firing wall and the ladle.

We provide an air curtain means positioned about the firing wall so as to direct a curtain of air toward the ladle and eliminate the air infiltration between the firing wall and the ladle lip. The air curtain means comprises an arcuate shaped tubing having a radius of curvatures slightly greater than the ladle lip and a plurality of spaced nozzles or a continuing slot extending from the tubing in angular relationship thereto and in a converging mode so as to direct the air curtain at the perimeter of the ladle lip. In addition, an insulating refractory is positioned radially inward of and in substantially abutting relationship to the tubing to reradiate escaping radiated heat back into the ladle. Our air curtain can completely surround an entire ladle or can surround a portion of the ladle depending on the desired flue location. Fluids other than air can be employed.

DESCRIPTION OF THE PREFERRED EMBODIMENTS

Figure 1:
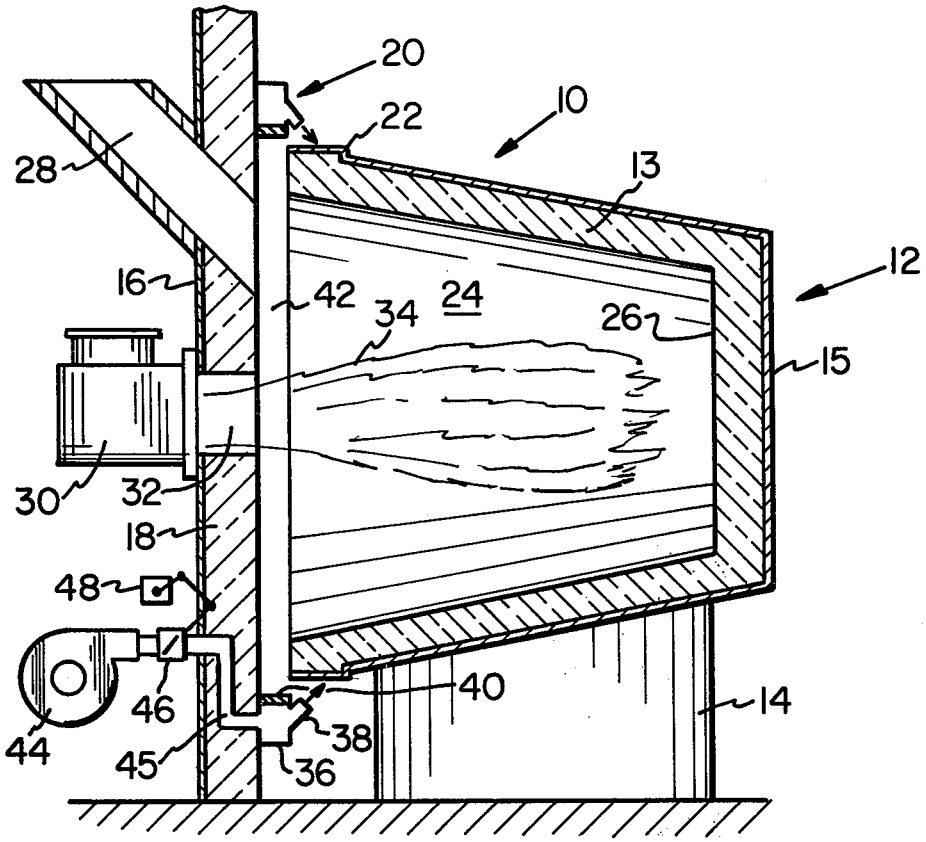
FIG. 1 is a lateral section through a cold air ladle preheat station embodying our invention.
Figure 2:
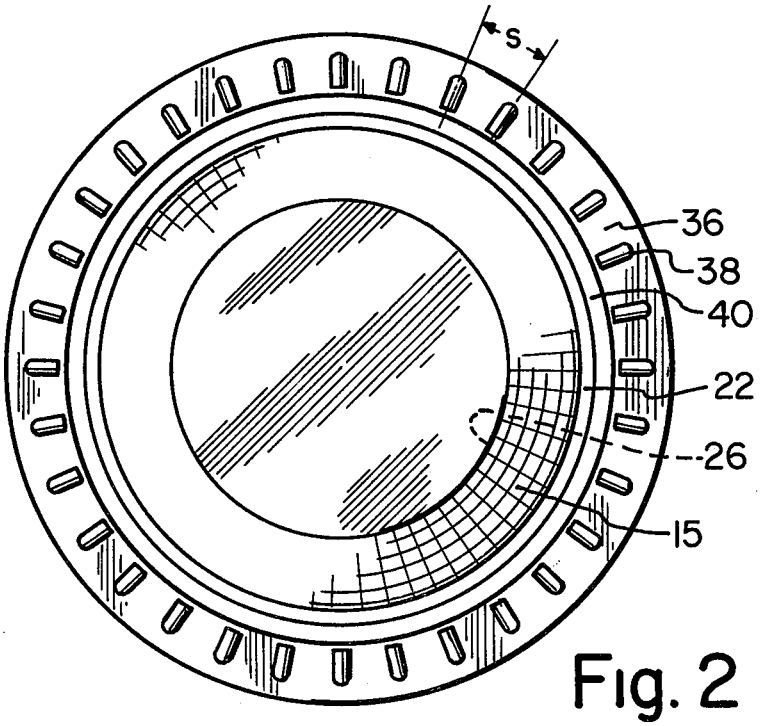
FIG. 2 is an end view of the ladle preheat station of FIG. 1.

Our ladle preheat station which may be fixed or moveable, generally designated 10 is illustrated in FIGS. 1 and 2. The particular station 10 illustrated is of the cold air type in that the products of combustion are not utilized in conjunction with recuperation to preheat the air for the burner. The station 10 includes a ladle stand 14 for accommodating ladle 12. Ladle 12 is positioned on its side and is retained by ladle stand 14 as is commonly known in the art, although the invention is also applicable to vertical heating stations. The ladle 12 includes metal shell 15 which is lined with refractory 13 so as to define a ladle bottom 26 and a ladle interior 24. The top of the ladle is defined by a ladle lip or rim 22.

The preheat station 10 also includes a structurally supported wall 16 having a refractory lining 18 along one side thereof. A central wall opening 32 accommodates a burner 30 mounted to the wall structure 16. Burner 30 can be any one of a number of types of burners which are fueled by gaseous or liquid fuel and mixed with an appropriate combustion sustaining gas such as air. The details of the burner do not form a part of this invention.

Extending outward from the upper portion of the wall 16 is an exhaust duct 28 which carries the spent products of combustion from the ladle preheat station 10. Burner 30 directs a flame 34 into the ladle interior 24 with the ladle being juxtapositioned to the wall 16 and refractory lining 18 so as to define a gap or slot 42 therebetween.

Figure 3:
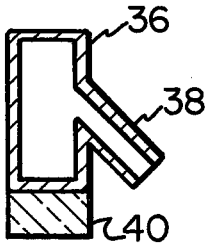
FIG. 3 is a lateral section through the tubing and adjacent refractory.

The air curtain assembly 20 is mounted to the refractory side of wall 16 so as to completely surround the ladle lip 22 in the area of the slot 42. Air curtain assembly 20 comprises an annular header or pipe or tubing 36 in FIG. 3. The diameter of the annular tubing 36 is slightly greater than the diameter of the ladle lip 22 so that if the ladle 12 were positioned against the refractory wall lining 18 the ladle 12 would be concentrically within the air curtain assembly 20. A plurality of spaced nozzles 38 extend inwardly from tubing 36 at an angle to the tubing 36 and in a converging mode. A continuing slot may be used as an alternative to the plurality of nozzles.

A forced air fan or blower 44 is mounted on the rear side of wall 16 and communicates with tubing 36 by means of an appropriate duct 45 extending through the wall 16 and the wall lining 18. A manual or automatic control valve 46 is connected in line with duct 45 and is operated by means of motor 48 to control the quantity of air supplied.

Insulating refractory 40 coextends with and is mounted at the inner-most edge, i.e. inner perimeter, of the tubing 36 so as to be located at the periphery of the gap 42 and adjacent to and slightly spaced from the ladle lip 22.

The nozzles 38 are spaced from one another by a distance S about the perimeter of the tubing 36, FIG. 2. The distance S will vary from installation to installation but generally a distance on the order of 6" or slightly more will provide the requisite air curtain. The cross section of the nozzle 38, its length and the angle it makes with respect to tubing 36 along with the spacing S of the nozzles can be determined for each particular installation to provide a continuous air curtain seal between the firing wall and the ladle lip itself.

In operation the burner 30 directs a flame 32 into the interior 24 of the ladle 12. The ladle 12 is spaced from the refractory wall lining 18 so as to define the gap 42 therebetween. The products of combustion exit the ladle interior 24 and are exhausted through stack 28 or the slot 42. The blower 44 provides forced air into the tubing 36 and out of the nozzles 38 so as to form an air curtain which impinges upon the perimeter of the ladle rim 22. This ladle curtain acts as a seal and prevents air infiltration into the slot 42 thus significantly reducing the fuel consumption required to heat the ladle.

Some heat transfer occurs as the heat is radiated off of the ladle refractory 13 and the wall lining 18 with certain of that radiated heat passing out of the gap or slot 42. The refractory 40 positioned at the inner edge of the tubing 36 acts to reradiate that heat radially inward and thus minimize the slot radiation heat losses. Again this reduces heat consumption for the entire ladle heating process.

Figure 4:
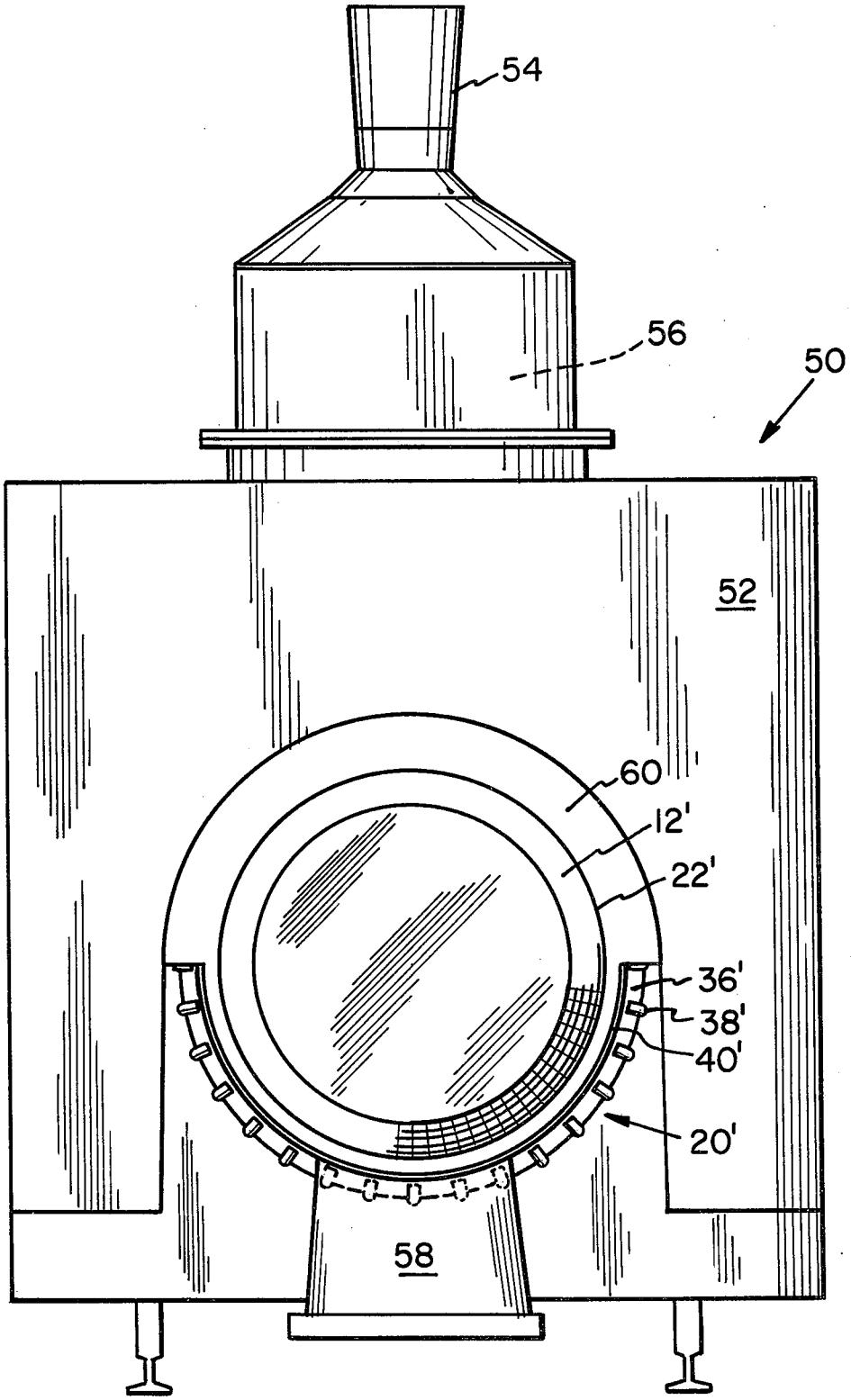
FIG. 4 is an end view of a hot air hooded ladle preheat station embodying our invention.

Our air curtain assembly 20' can also be employed with a hot air preheat ladle station generally designated 50, FIG. 4. The hot air ladle reheat station 50 includes a ladle stand 58 to accommodate a ladle 12' as in the earlier embodiment. Ladle 12' is juxtapositioned against a burner wall (not shown). The burner wall is encapsulated by a hood 52 which extends about the forward portion of the ladle 12' so as to define a gap 60. The purpose of the gap 60 is to permit air to be drawn around the ladle where it mixes with the products of combustion exiting from the ladle and then pass through a recuperator 56 located subjacent a stack 54. Since it is necessary to mix this dilution air with the products of combustion exiting the ladle, the upper portion of the slot through which the rising gases will exit must remain open. However, the air curtain assembly 20' is utilized along the lower portion of the ladle so as to form an air curtain which minimizes air infiltration along the bottom of the ladle while allowing the products of combustion and dilution air to be collected and appropriately flowed through the recuperator 56 and out of the stack 54.

The air curtain assembly 20' is basically the same as in the earlier embodiment except that it extends through an arc of less than 360° rather than a full 360°. The assembly 20' comprises tubing 36' having a series of spaced nozzles 38' directed divergently inward towards the ladle lip 22'. A refractory lining 40' is positioned along the inner-most surface of the tubing 38' so as to reradiate the heat and minimize slot radiation heat losses as in the earlier embodiment. A forced air fan and motor operated valves (not shown) are employed. Again the quantity of sealed air is dependent on the burner firing rate and the gap between the firing wall and the ladle and the motorized valve can be controlled to provide the necessary air curtain.

It can thus be seen that we have provided an air seal to improve the efficiency of the heating of the ladle by eliminating air infiltration and also minimizing radiation heat losses. Other available fluids may be used to form the curtain, although air, as the most available fluid, is preferred. Various other changes and modifications may be made within the contemplation of our invention and within the scope of the following claims.

We claim:

1. A cold air ladle preheat station including a refractory lined firing wall having a burner extending therethrough, a ladle adapted to be juxtapositioned with respect to the wall so as to form a gap between a ladle lip and the wall and permit firing into a ladle interior, an air seal supply duct having a shape adapted to be in substantial conformity to said ladle lip, positioned about said firing wall and perimetrically dimensioned slightly larger than the ladle lip, an insulating refractory positioned so as to extend along an inner edge of the air seal supply duct, said duct including a plurality of spaced nozzles directed inwardly in a converging mode so as to direct air toward a perimeter of said ladle lip and form an air curtain across said gap to prevent air infiltration.

2. The cold air ladle preheat station of claim 1, said duct extending 360°.

3. The cold air ladle preheat station of claim 1, including a blower fan mounted on the side of the firing wall opposite said ladle side and having a fluid supply line extending through the firing wall and in fluid communication with said duct.

4. The cold air ladle preheat station of claim 3, including a motor operated valve for controlling the quantity of fluid to the duct.

5. A hot air ladle preheat station including a vertically disposed refractory lined firing wall having a burner extending therethrough, a ladle adapted to be juxtapositioned horizontally with respect to the wall so as to form a gap between a ladle lip and the wall and permit firing into a ladle interior, a hood positioned about said wall and extending to said ladle so as to form a dilution air space between the hood and ladle, an arcuate air supply duct extending through about 180° and positioned about said firing wall and perimetrically dimensioned slightly larger than the ladle lip, an insulating refractory positioned so as to extend along an inner edge of the air supply duct, said duct located opposite the bottom half of the ladle lip and including a plurality of spaced nozzles directed inwardly in a converging mode so as to direct air toward a perimeter of said ladle lip and form an air curtain across said gap to prevent air infiltration.

6. The hot air ladle preheat station of claim 5, including a blower fan mounted on the side of the firing wall opposite said ladle side and having a fluid supply line extending through the firing wall and in fluid communication with the air supply duct.

7. The hot air ladle preheat station of claim 6, including a motor operated valve for controlling the quantity of fluid to the air supply duct.

* * * * *